US011993927B2

(12) United States Patent
Beyreuther et al.

(10) Patent No.: US 11,993,927 B2
(45) Date of Patent: May 28, 2024

(54) SHEAR WALL ASSEMBLY

(71) Applicant: Mercer Mass Timber LLC, Vancouver (CA)

(72) Inventors: Todd Beyreuther, Spokane, WA (US); Daniel Koeberl, Graz (GR); Darrin Griechen, Spokane, WA (US)

(73) Assignee: Mercer Mass Timber LLC, Spokane Valley, WA (US)

( * ) Notice: Subject to any disclaimer, the term of this patent is extended or adjusted under 35 U.S.C. 154(b) by 0 days.

(21) Appl. No.: 18/222,336

(22) Filed: Jul. 14, 2023

(65) Prior Publication Data

US 2023/0349149 A1 Nov. 2, 2023

Related U.S. Application Data

(62) Division of application No. 16/944,492, filed on Jul. 31, 2020, now Pat. No. 11,702,837.

(60) Provisional application No. 62/881,585, filed on Aug. 1, 2019.

(51) Int. Cl.

| | |
|---|---|
| ***E04B 1/48*** | (2006.01) |
| ***E04B 1/10*** | (2006.01) |
| ***E04B 1/98*** | (2006.01) |
| ***E04B 2/04*** | (2006.01) |

(52) U.S. Cl.

CPC ..... *E04B 1/486* (2013.01); *E04B 1/10* (2013.01); *E04B 1/98* (2013.01); *E04B 2/04* (2013.01)

(58) Field of Classification Search

CPC ... E04B 1/486; E04B 1/10; E04B 1/98; E04B 2/04

See application file for complete search history.

(56) References Cited

U.S. PATENT DOCUMENTS

| | | | |
|---|---|---|---|
| 2,011,312 | A | 8/1935 | Vilhelm |
| 3,621,626 | A | 11/1971 | Tylius |
| 4,249,354 | A | 2/1981 | Wynn |
| 4,604,003 | A | 8/1986 | Francoeur et al. |
| 4,875,314 | A | 10/1989 | Boilen |
| 4,956,947 | A | 9/1990 | Middleton |
| 5,168,681 | A | 12/1992 | Ayrapetyan |

(Continued)

OTHER PUBLICATIONS

Notice of Allowance for U.S. Appl. No. 16/944,492, dated May 5, 2022, 16 pages.

(Continued)

*Primary Examiner* — Rodney Mintz

(74) *Attorney, Agent, or Firm* — Elliott, Ostrander & Preston, P.C.

(57) ABSTRACT

A shear wall assembly is provided. The assembly includes a first anchor, a second anchor, a third anchor, a first bolt, a second bolt, a seismic fuse, and a rod. Each anchor includes a hollow tubular body including a first open end, a second open end, an interior including female threads, and an exterior including male threads. Each bolt includes a head and a shank. The shank includes male threads. The shank extends through an open end of an anchor. The male threads of the bolt engage with the female threads of the anchor. The seismic fuse is configured to receive the heads of the bolts and includes a hole. The rod includes an end with male threads. The rod extends through the hole of the seismic fuse into the open end of an anchor. The male threads of the rod engage with the female threads an anchor.

8 Claims, 10 Drawing Sheets

(56) References Cited

U.S. PATENT DOCUMENTS

| | | | |
|---|---|---|---|
| 5,384,993 | A | 1/1995 | Phillips |
| 5,386,671 | A | 2/1995 | Hu et al. |
| 5,448,861 | A | 9/1995 | Lawson |
| 5,531,054 | A | 7/1996 | Ramirez |
| 5,535,561 | A | 7/1996 | Schuyler |
| 5,669,189 | A | 9/1997 | Logiadis et al. |
| 5,675,943 | A | 10/1997 | Southworth |
| 5,956,917 | A | 9/1999 | Reynolds |
| 6,014,843 | A | 1/2000 | Crumley et al. |
| 6,067,769 | A | 5/2000 | Hardy |
| 6,134,860 | A | 10/2000 | Pagano et al. |
| 6,161,339 | A | 12/2000 | Cornett et al. |
| 6,195,949 | B1 | 3/2001 | Schuyler |
| 6,282,859 | B1 | 9/2001 | Heijden |
| 6,557,316 | B2 | 5/2003 | Heijden |
| 7,150,132 | B2 | 12/2006 | Commins |
| 7,313,890 | B2 | 1/2008 | Clarke |
| 7,506,479 | B2 | 3/2009 | Pryor |
| 7,980,033 | B1 | 7/2011 | Fyfe |
| 8,161,697 | B1 | 4/2012 | McDonald |
| 8,327,592 | B2 | 12/2012 | Lafferty, III et al. |
| 8,635,820 | B2 | 1/2014 | Lafferty, III et al. |
| 8,689,518 | B2 | 4/2014 | Gridley et al. |
| 8,806,833 | B2 | 8/2014 | Lafferty, III et al. |
| 8,935,892 | B2 | 1/2015 | Buchanan et al. |
| 8,950,126 | B2 | 2/2015 | Imai et al. |
| 10,081,961 | B1 | 9/2018 | Blomgren |
| 10,267,053 | B2 | 4/2019 | Blomgren |
| 11,702,837 | B2 * | 7/2023 | Beyreuther ..... E04B 2/04 52/656.9 |
| 2003/0167711 | A1 | 9/2003 | Lstiburek |
| 2010/0186316 | A1 | 7/2010 | Buchanan et al. |
| 2013/0019545 | A1 | 1/2013 | Buchanan et al. |
| 2014/0090315 | A1 | 4/2014 | Imai et al. |
| 2018/0363317 | A1 | 12/2018 | Blomgren |
| 2019/0376278 | A1 | 12/2019 | Espinosa |
| 2020/0299962 | A1 | 9/2020 | Espinosa |
| 2021/0032858 | A1 * | 2/2021 | Beyreuther ..... E04B 1/10 |
| 2022/0136232 | A1 * | 5/2022 | Schneider ..... E04B 1/2403 52/646 |
| 2022/0275634 | A1 * | 9/2022 | Malczyk ..... E04B 1/10 |
| 2022/0275635 | A1 * | 9/2022 | Malczyk ..... E04B 1/388 |

OTHER PUBLICATIONS

Restriction Requirement for U.S. Appl. No. 16/944,492, dated Oct. 21, 2021, 9 pages.

* cited by examiner

SHEAR WALL ASSEMBLY

CROSS-REFERENCE TO RELATED APPLICATIONS

This application is a divisional of U.S. patent application Ser. No. 16/944,492, filed on Jul. 31, 2020, which claims the benefit of U.S. Provisional Application No. 62/881,585 filed Aug. 1, 2019 for SHEAR WALL ASSEMBLY, the entire contents of which are hereby incorporated by reference herein.

FIELD OF INVENTION

The present invention relates generally to a connector, and more specifically to a connector that connects cross laminated timber subassemblies and a shear wall assembly that connects cross laminated timber subassemblies with cold formed steel and light wood frame sheathed shear walls.

BACKGROUND

Buildings must conform to stringent building standards and codes. The International Code Council (ICC) developed a model building code known as the International Building Code (IBC) to protect public health and safety regarding construction. The ICC has a listing program that offers a fast and cost-effective way for manufacturers of building products to show that their product complies with applicable standards referenced in building and other applicable codes. A connector that connects cross laminated timber (CLT) sub assemblies and a shear wall assembly that connects CLT subassemblies with cold formed steel and light wood frame sheathed shear walls that comply with building codes and qualify for the ICC listing program would be advantageous.

SUMMARY

A shear wall assembly to connect hybrid CLT shear walls with CLT floor diaphragms is provided. The assembly includes a first anchor, a second anchor, a third anchor, a first bolt, a second bolt, a seismic fuse, and a rod. Each anchor includes a hollow tubular body including a first open end, a second open end, an interior including female threads and an exterior including male threads. Each bolt includes a head and a shank. The shank includes male threads. The shank extends through an open end of an anchor. The male threads of the bolt engage with the female threads of the interior of the anchor. The seismic fuse is connected to receive the heads of the bolts. The seismic fuse also includes a hole. The rod includes an end with male threads. The rod extends through the hole of the seismic fuse into the open end of an anchor. The male threads of the rod engage with the female threads of the interior of the anchor.

BRIEF DESCRIPTION OF THE DRAWINGS

The foregoing summary, as well as the following detailed description will be better understood when read in conjunction with the appended drawings. For the purpose of illustration, there is shown in the drawings different embodiments. It should be understood, however, that the teachings are not limited to the precise connector and shear wall assembly shown.

FIG. 2*b* is a perspective view of the floor beam and floor section with a

DETAILED DESCRIPTION

A connector that connects cross laminated timber (CLT) subassemblies and a shear wall assembly that connects CLT subassemblies with cold formed steel and light wood frame sheathed shear walls that comply with building codes and qualify for the International Code Council (ICC) listing program is provided.

Figure 1:
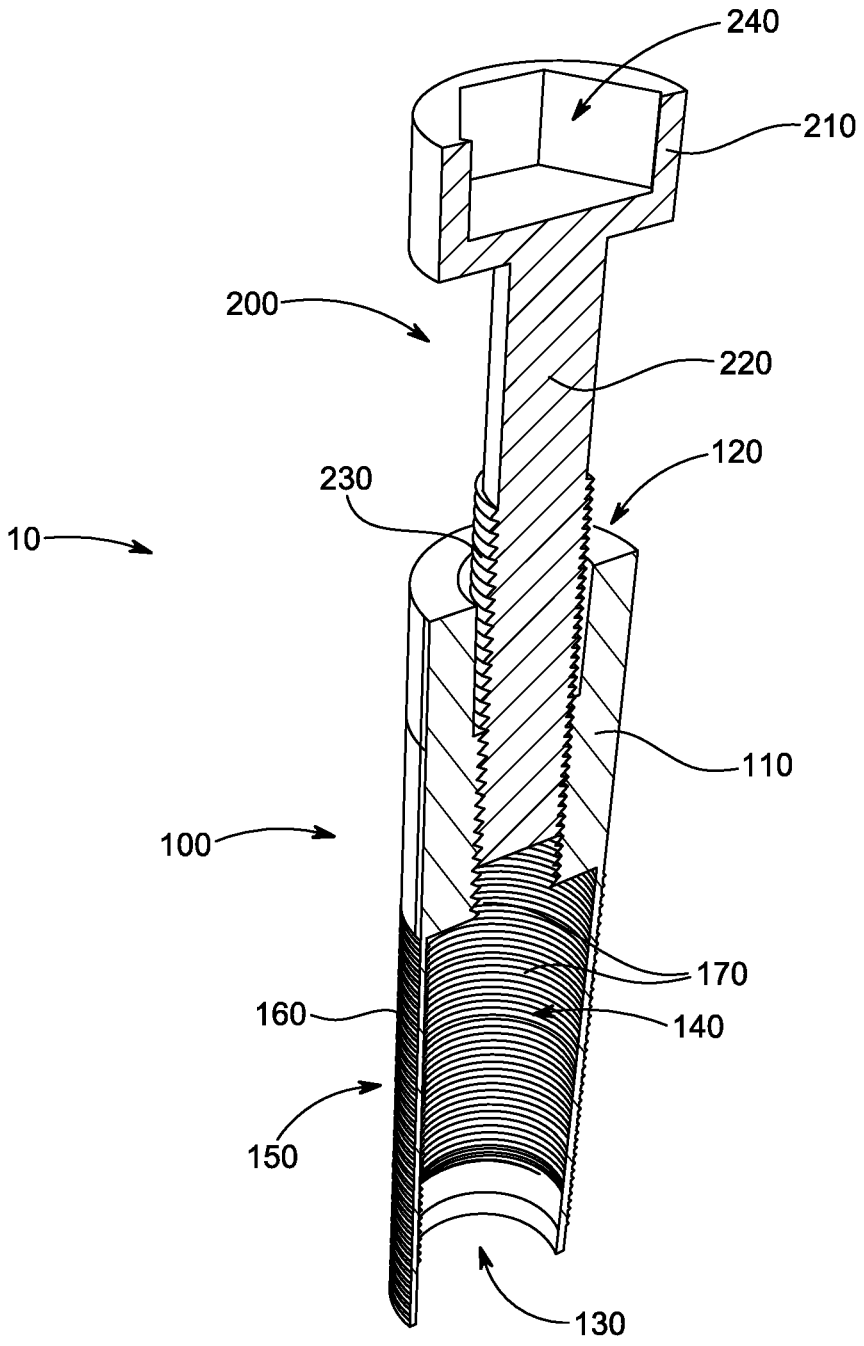
FIG. 1 is a section view of a connector.

FIG. 1 is a section view of a connector 10. As shown in FIG. 1, a connector 10 including an anchor 100 and a bolt 200 to connect a floor system is provided. The anchor 100 includes a hollow tubular body 110. The hollow tubular body 110 includes a first open end 120 and a second open end 130. The hollow tubular body 110 also includes an interior 140 and an exterior 150. As shown in FIG. 1, the exterior 150 of the body 110 includes male threads 160. The diameter of the exterior 150 of the anchor 100 may be approximately 40-60 mm. The interior 140 of the body 110 may include female threads 170. As shown in FIG. 1, the diameter of the interior 140 may vary. For example, a portion of the interior 140 nearest the first open end 120 may have a smaller diameter than the interior 140 nearest the second open end 130.

The bolt 200 includes a head 210 and a shank 220. The shank includes male threads 230. The diameter of the shank 220 and the diameter of the portion of the interior 140 nearest the first open end 120 are complimentary so that the shank 220 of the bolt 200 may be screwed into the interior 140 of the anchor 100 through the first open end 120. The male threads 230 of the shank 220 engage with the female threads 170 of the interior 140 of the anchor 100. The head 210 of the bolt 200 may include a recess 240 to allow a tool to screw the bolt 200 into the anchor 100. The bolt may be a 20 mm to 80 mm metric screw. The bolt may be a 40 mm metric screw with inner hex wrench.

Figure 2A:
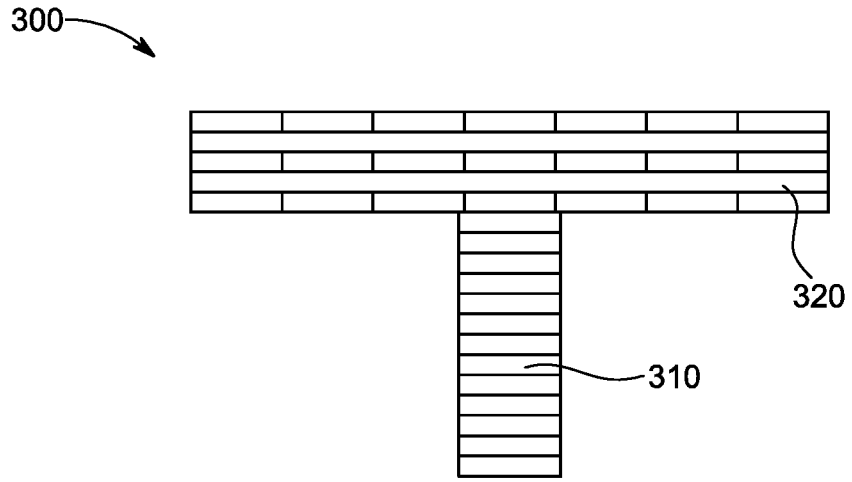
FIG. 2*a* is a section view of a floor beam and floor section.
Figure 2B:
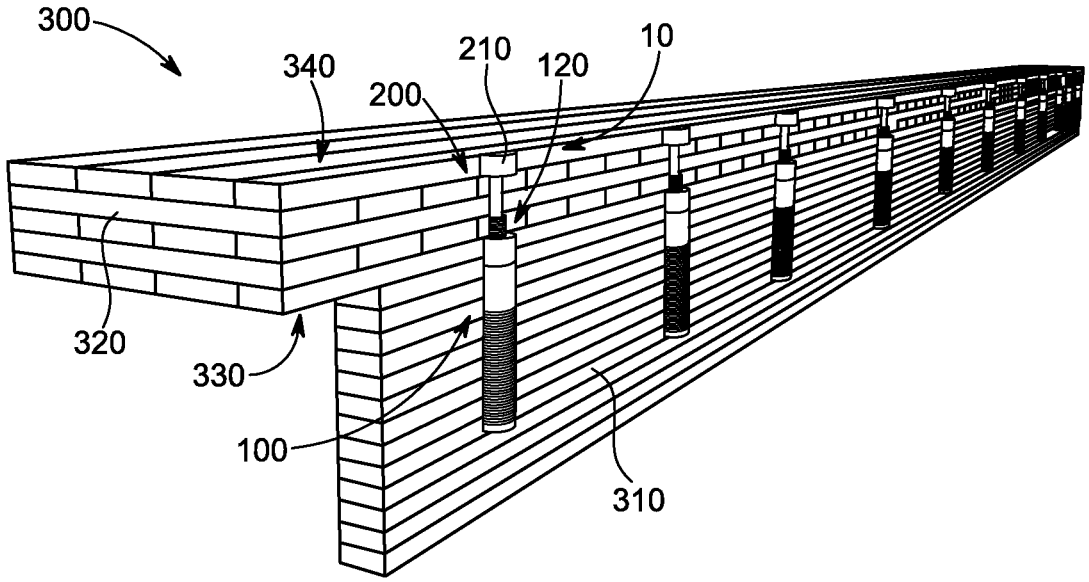

FIG. 2*a* is a section view of a floor beam 310 and floor section 320. FIG. 2*b* is a perspective view of the floor beam 310 and floor section 320 with a plurality of connectors 10 installed. As shown in FIGS. 2*a*-2*b*, a plurality of connectors 10 may be used to connect a floor system 300. More specifically, the connectors 10 may be utilized in mechanical timber-timber shear and tension transfer in out-of-plane applications with long-span floor systems. As shown in FIG. 2*a*, the floor system 300 includes at least a floor beam 310 and a floor 320. The span of the floor 320 may be greater than 20 feet wherein the span is measured from centerline to centerline between beams. As shown in FIG. 2*b*, a plurality of connectors 10 are used to connect the floor 320 to the floor beam 310. The anchors 100 are embedded into the floor beam 310. To connect the floor 320 to the floor beam 310, the bolts 200 are screwed into the floor 320 and the embedded anchors 100. The floor beam 310 and the floor 320 may be made from cross laminated timber (CLT). The floor 320 may be predrilled to provide a recess to allow the first open end 120 of the anchor 100 to protrude partially into the bottom 330 of the floor 320. The floor 320 may also be predrilled to allow the head 210 of the bolt 200 to sit flush with the top 340 of the floor 320.

Figure 3A:
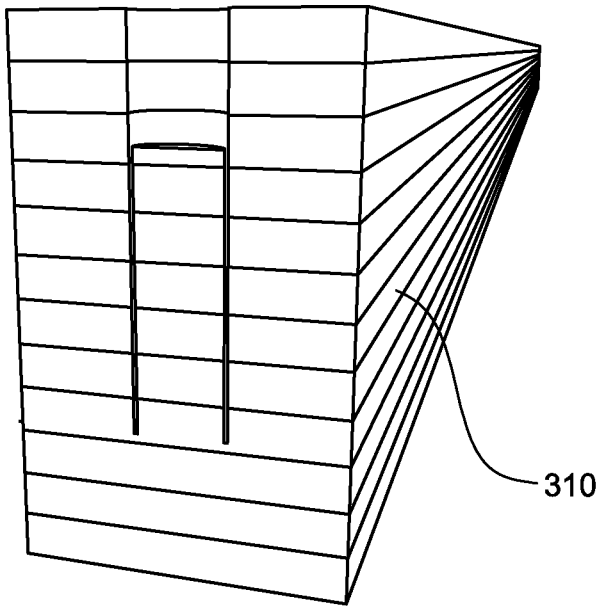
FIG. 3*a* is a perspective view of a section of the floor beam.
Figure 3B:
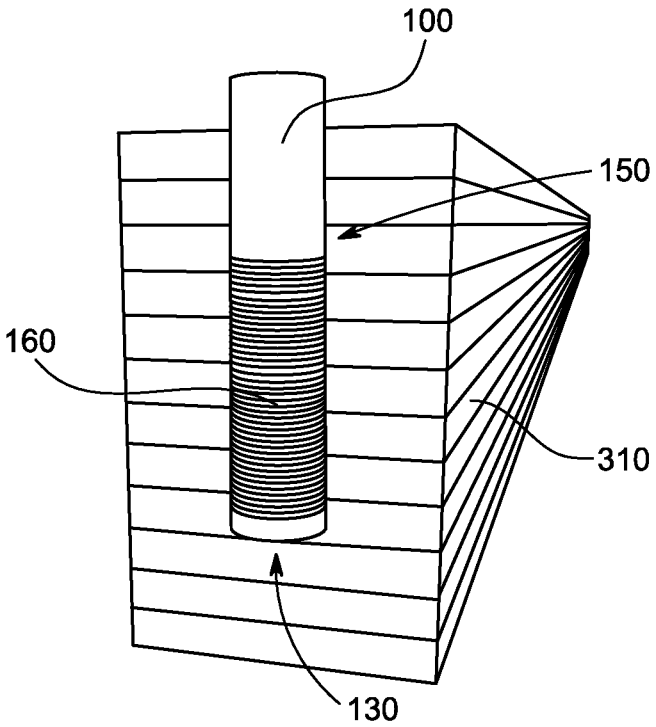
FIG. 3*b* is a perspective view of a section of the floor beam with an anchor installed.
Figure 3C:
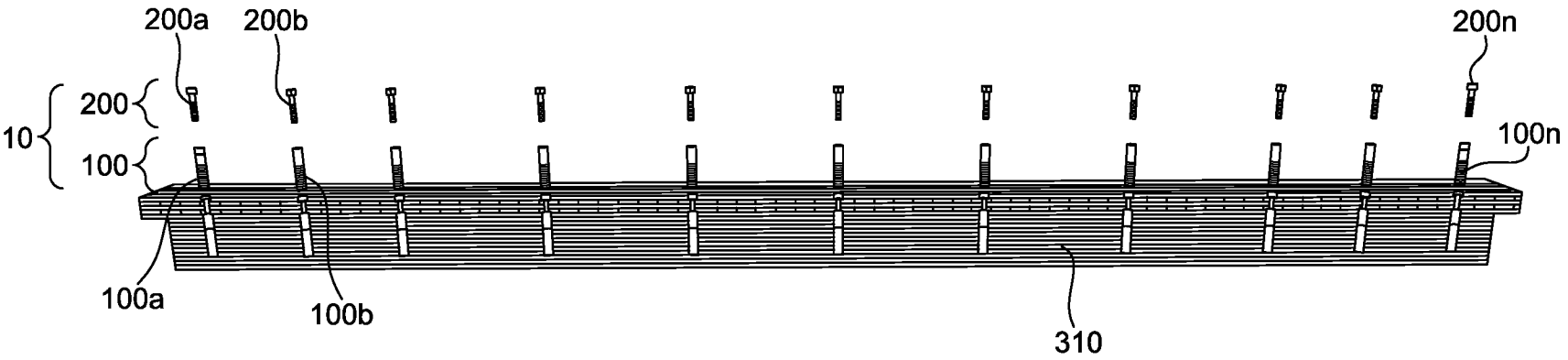
FIG. 3*c* is an exploded view of a section view of the floor beam and the plurality of connectors.
Figure 4:
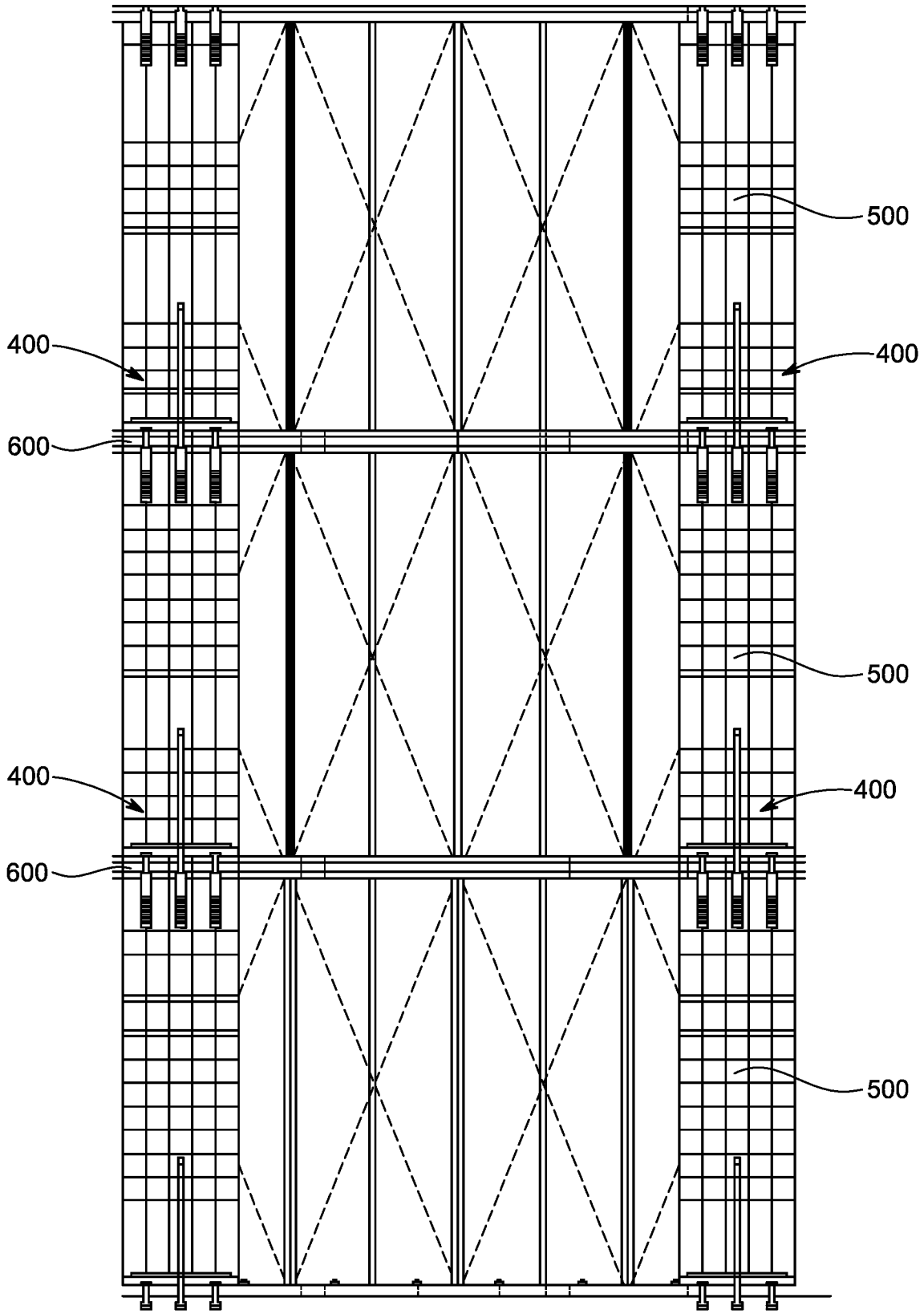
FIG. 4 is a cross section of a low-rise building.

FIG. 3*a* is a perspective view of a section of the floor beam 310. FIG. 3*b* is a perspective view of a section of the floor beam 310 with an anchor 100 installed. FIG. 3*c* is an exploded view of a section view of the floor beam 310 and the plurality of connectors 10. As shown in FIG. 3*a*-3*c*, the floor beam 310 may be predrilled to allow the anchor 100 to screw into the floor beam 310. As shown in FIG. 3*a*, the floor beam 310 is predrilled to compliment the anchor's 100 interior 140 and exterior 150 diameters as illustrated in FIG. 1. As shown in FIG. 3*b*, the second open end 130 of the anchor 100 is screwed into the floor beam 310 at the predrilled location. The male threads 160 on the exterior 150 of the anchor 100 and the female threads 170 on the interior 140 portion closest to the second open end 130 (shown in FIG. 1) engage with the floor beam 310. As shown in FIG. 3*c*, a plurality of connectors 10 including anchors 100 and bolts 200 are installed to connect the floor 320 (not illustrated for clarity) to the floor beam 310. Although eleven connectors 10 are illustrated in FIG. 3*c*, any number of connectors 10 may be used to connect the floor 320 to the floor beam 310 according to design loads. The spacing of the connectors 10 are dependent on performance and design requirements FIG. 4 is a cross section of a low-rise building. As shown in FIG. 4, a shear wall assembly 400 that may be used to connect floor diaphragms 600 and walls 500 of low-rise buildings is also provided. The shear wall assembly 400 may be used to combine CLT subassemblies with cold formed steel (CFS) and light wood frame (LWF) sheathed shear walls.

Figure 5:
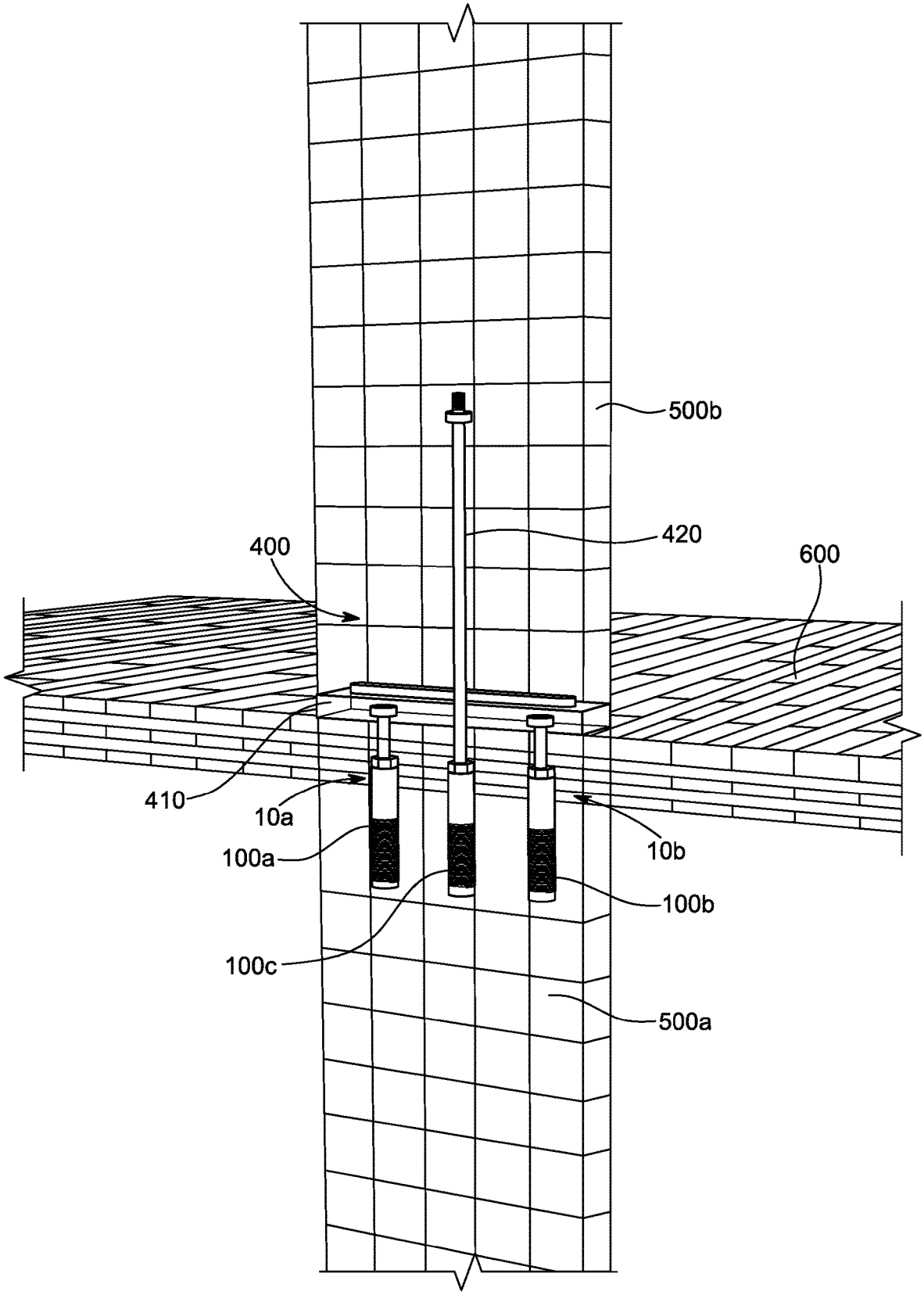
FIG. 5 is a shear wall assembly.

FIG. 5 is a shear wall assembly 400. As shown in FIG. 5, the shear wall assembly 400 may be used to connect a first wall pier 500*a*, a floor diaphragm 600, and a second wall pier 500*b*. The shear wall assembly 400 includes a first connecter 10*a*, a second connector 10*b*, a third anchor 100*c*, a seismic fuse 410, and a rod 420. The first connector 10*a* includes a first anchor 100*a* and a first bolt 200*a*, and the second connector 10*b* includes a second anchor 100*b* and a second bolt 200*b*. The first and second connectors 10*a*, 10*b* include the details and embodiments of the connectors 10 previously described. The third anchor 100*c* includes the details and embodiments of the anchor 100 previously described.

Figure 6:
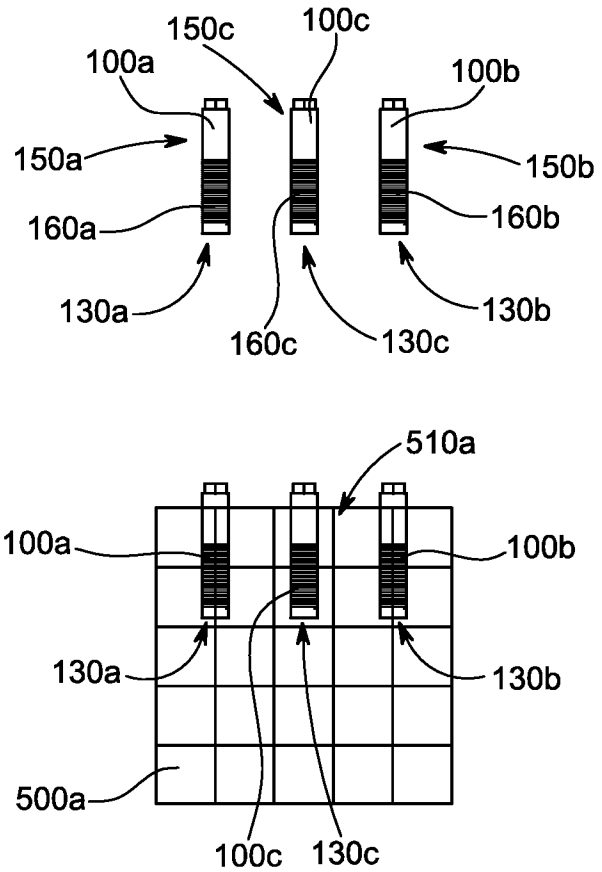
FIG. 6 is an elevation view of a first anchor, a second anchor, and a third anchor being installed in a first wall pier.

FIG. 6 is an elevation view of a first anchor 100*a*, a second anchor 100*b*, and a third anchor 100*c* being installed in a first wall pier 510*a*. As shown in FIG. 6, the first anchor 100*a*, the second anchor 100*b*, and the third anchor 100*c* are screwed and embedded into the first wall pier 500*a*. The first wall pier 500*a* may be made from CLT. The top 510*a* of the first wall pier 500*a* may be predrilled similarly to the floor beam 310 described in FIG. 3*a*. The second open ends 130*a*-*c* of the anchors 100*a*-*c* are screwed into the first wall pier 500*a* at the predrilled locations. The male threads 160*a*-*c* on the exteriors 150*a*-*c* of the anchors 100*a*-*c* and the female threads 170*a*-*c* on the interior 140*a*-*c* portions closest to the second open ends 130*a*-*c* (as shown in FIG. 1) engage with the first wall pier 500*a*. The anchors 100*a*-*c* may be factory installed.

Figure 7:
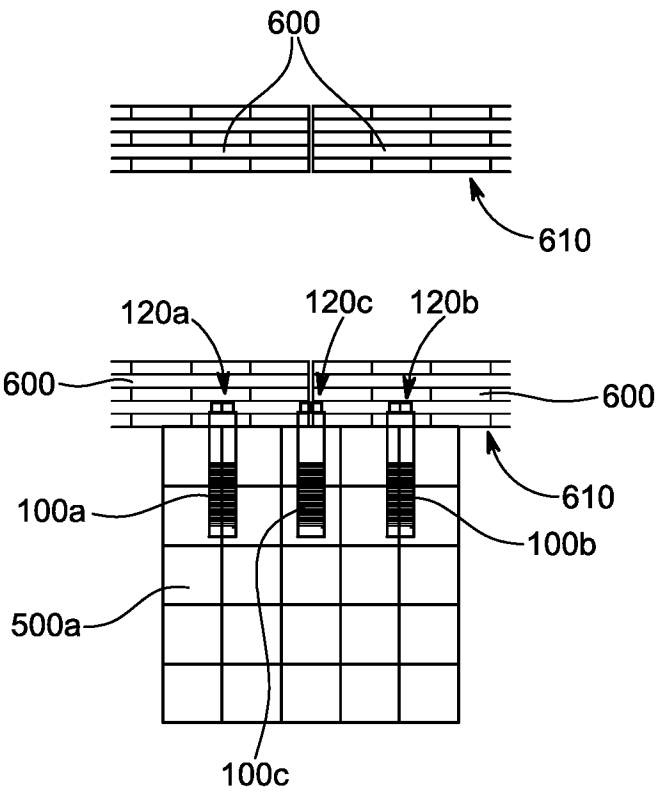
FIG. 7 is an elevation view of a floor diaphragm being installed on the anchors.

FIG. 7 is an elevation view of a floor diaphragm 600 being installed on the anchors 100*a*, 100*b*, 100*c*. As shown in FIG. 7, after the first wall pier 500*a* is installed in the field, the floor diaphragm 600 is installed. The floor diaphragm 600 may be installed as one section or as two sections as shown in FIG. 7. The placement of the floor diaphragm 600 is indexed to the location of the anchors 100*a*-*c*. The floor diaphragm 600 may be made from CLT. The floor diaphragm 600 may be predrilled to provide a recess to allow the first open ends 120*a*-*c* of the anchors 100*a*-*c* to protrude partially into the bottom 610 of the floor diaphragm 600.

Figure 8:
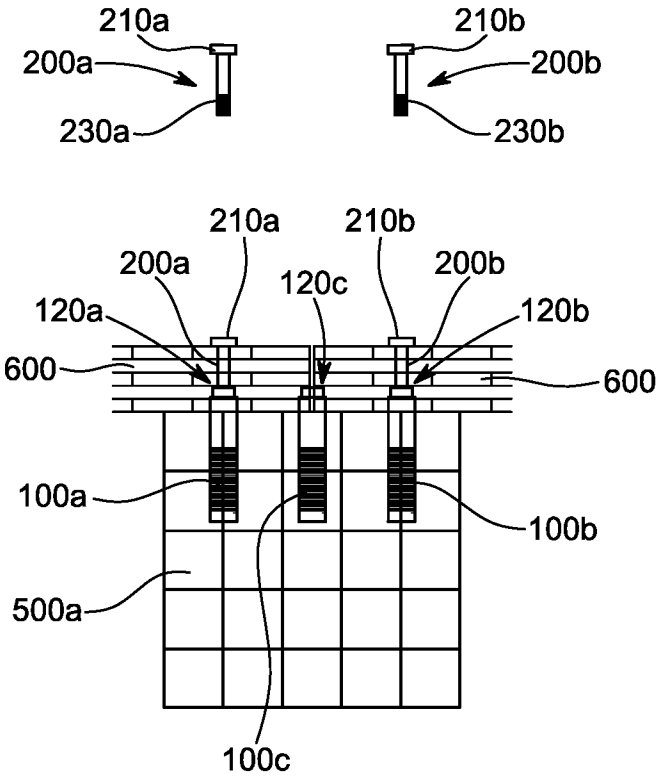
FIG. 8 is an elevation view of a first bolt and a second bolt being installed in the anchors.

FIG. 8 is an elevation view of a first bolt 200*a* and a second bolt 200*b* being installed in the anchors 100*a*, 100*b*. As shown in FIG. 8, after the floor diaphragm 600 is installed, the first and second bolts 200*a*, 200*b* are installed. The first and second bolts 200*a*-*b* extend through the floor diaphragm 600 into the first open ends 120*a*-*b* of the first and second anchors 100*a*-*b* respectively. The male threads 230*a*-*b* of the bolts 200*a*-*b* engage with the female threads 170*a*-*b* on the interiors 140*a*-*b* of the first and second anchors 100*a*-*b*. The bolts 200*a*-*b* clamp the floor 600 to the first wall pier 500*a*.

Figure 9:
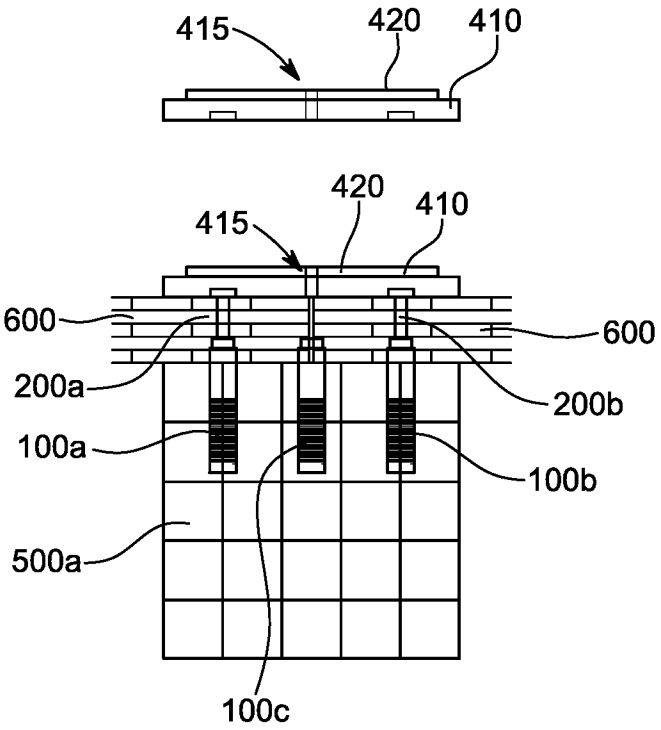
FIG. 9 is an elevation view of a seismic fuse being installed.

FIG. 9 is an elevation view of a seismic fuse 410 being installed. As shown in FIG. 9, the seismic fuse 410 is installed over the heads 2 10*a*-*b* of the bolts 200*a*-*b*. The seismic fuse 410 may include recesses configured to receive the heads 2 10*a*-*b* of the bolts 200*a*-*b*. The seismic fuse 410 may also include a protrusion 420. The seismic fuse 410 includes a hole 415 that aligns with the location of the third anchor 100*c* after placement. The placement of the seismic fuse 410 is indexed to the location of the bolts 200*a*-*b*.

Figure 10:
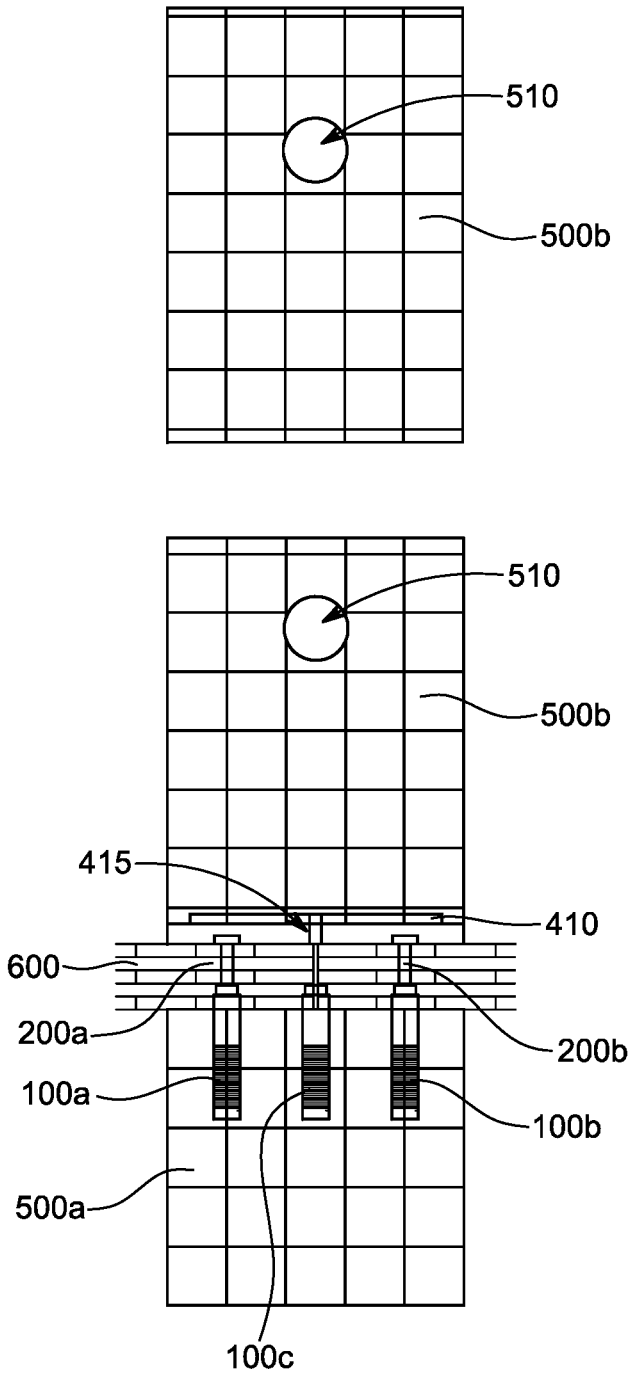
FIG. 10 is an elevation view of a second wall pier being installed.

FIG. 10 is an elevation view of a second wall pier 500*b* being installed. As shown in FIG. 10, after the seismic fuse 410 is placed, the second wall pier 500*b* is installed on the seismic fuse 410. The placement of the second wall pier 500*b* is indexed to the location of the seismic fuse 410. The bottom of the second wall pier 500*b* may include a recess configured to receive the protrusion 420 (shown in FIG. 9) on the seismic fuse 410. The second wall pier 500*b* may include an opening 510. The second wall pier 500*b* may be made from CLT. The second wall pier 500*b* is predrilled from the bottom of the opening 510 to the bottom of the second wall pier 500*b*. The floor 600 may also be predrilled so that there is an open path from the first open end 120*c* of the third anchor 100*c* to the bottom of the opening 510 in the second wall pier 500*b*.

Figure 11:
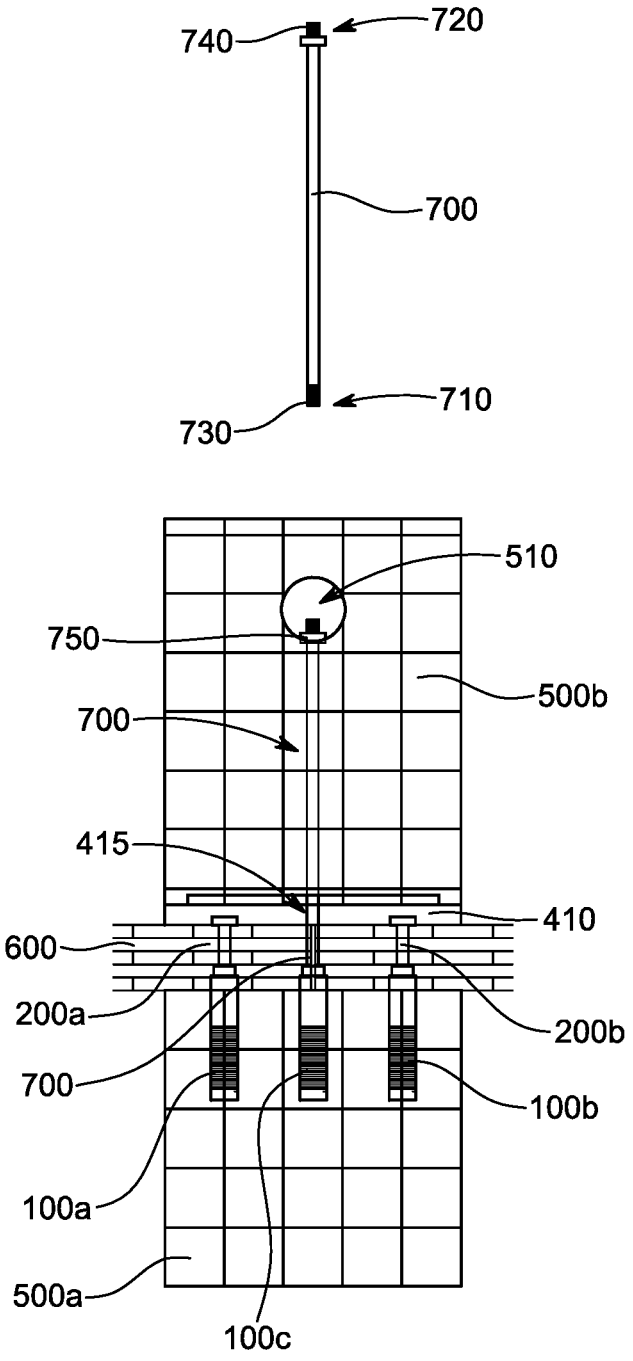
FIG. 11 is an elevation view of a rod being installed.

FIG. 11 is an elevation view of a rod 700 being installed. As shown in FIG. 11, after the second wall pier 500*b* is placed, the rod 700 is installed. The length of the rod 700 may vary according to design loads. The rod 700 may be an M30 metric rod. The rod 700 includes a first end 710 and a second end 720. At least a portion of both ends 710, 720 of the rod 700 include male threads 730, 740. The rod 700 is placed by sliding the first end 710 of the rod 700 through the opening 510 in the second wall pier 500*b* down the predrilled open path to the first open end 120 of the third anchor 100*c*. The male threads 730 of the first end 710 of the rod 700 screw into and engage with the female threads 170*c* on the interior 140*c* of the third anchor 100*c*. The rod 700 is secured to the second wall pier 500*b* by screwing a nut 750 onto the male threads 740 of the second end 720 of the rod 700. The nut 750 is screwed onto the second end 720 until the nut 750 is snug against the bottom of the opening 510.

In the assembly described in FIGS. 5-11, the anchors 100*a-c* are designed for diaphragm and Lateral Force Resistant Systems (LFRS) shear transfer as well as compression transfer. The floor diaphragm 600 is designed for diaphragm shear transfer. The floor diaphragm 600 transfers dead and live loads to the wall piers 500*a,b*. The bolts 200*a,b* are designed for diaphragm shear transfer and compression perpendicular to the grain transfer. The seismic fuse 410 is designed to dissipate seismic energy. The seismic fuse 410 transfers compression bearing and shear to the bolts 200*a,b*. The rod 600 is designed for overturning resistance. The shear wall assembly 400 may be designed to comply with building and applicable codes set forth by the ICC.

Having thus described in detail a preferred selection of embodiments of the present invention, it is to be appreciated and will be apparent to those skilled in the art that many physical changes could be made to the connector 10 and shear wall assembly 400 without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A connector comprising:

an anchor including a hollow tubular body including a first open end, a second open end, an interior, and an exterior, the interior including female threads and the exterior including male threads; and a bolt including a shank including second male threads, the shank extending through the first open end into the interior of the anchor;

wherein the second male threads of the bolt engage with the female threads of the anchor, wherein the interior of the anchor includes a first portion proximate the first open end and a second portion proximate the second open end, the first portion having a smaller diameter than the second portion.

2. The connector of claim 1, wherein the bolt further includes a head, the head including a recess configured to receive a tool.

3. The connector of claim 1, wherein the bolt is a 20-80 mm metric screw.

4. A floor system comprising:

a floor beam including a plurality of anchors, each anchor of the plurality of anchors including a hollow tubular body including a first open end, a second open end, an interior, and an exterior, the interior including female threads and the exterior including male threads; and a floor connected to the floor beam with a plurality of bolts, each bolt of the plurality of bolts including a shank including second male threads, the shank extending through the first open end into the interior of the anchor;

wherein the second male threads of each bolt engage with the female threads of each anchor, wherein the interior of the anchor includes a first portion proximate the first open end and a second portion proximate the second open end, the first portion having a smaller diameter than the second portion.

5. The floor system of claim 4, wherein the floor spans about 20 feet.

6. The floor system of claim 4, wherein the floor beam and the floor are cross laminated timber (CLT).

7. The floor system of claim 4, wherein each bolt further includes a head, the head including a recess configured to receive a tool.

8. The floor system of claim 4, wherein each bolt is a 20-80 mm metric screw.

* * * * *